US006357848B1

(12) United States Patent
Underwood et al.

(10) Patent No.: US 6,357,848 B1
(45) Date of Patent: Mar. 19, 2002

(54) APPARATUS AND METHOD FOR REDUCING EDGE MARGIN TOLERANCES IN A PRINTING DEVICE WITH ONE OR MORE SUPPLIES OF PRINT MEDIA

(75) Inventors: John A. Underwood; Steve O. Rasmussen, both of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/470,173

(22) Filed: Dec. 22, 1999

(51) Int. Cl.[7] ..... B41J 29/38
(52) U.S. Cl. ..... 347/16; 347/101; 271/265.01
(58) Field of Search ..... 347/16, 101, 104, 347/19; 400/630, 632, 579; 271/265.01; 399/361–410; 346/134; 358/1.12

(56) References Cited

U.S. PATENT DOCUMENTS 5,346,202 A * 9/1994 Jurkewitz ..... 271/258

FOREIGN PATENT DOCUMENTS

JP 360067349 A * 4/1985

* cited by examiner

*Primary Examiner*—N. Le
*Assistant Examiner*—Shih-wen Hsieh
(74) *Attorney, Agent, or Firm*—Erik A. Anderson

(57) ABSTRACT

An apparatus and method for reducing print media edge margin tolerances in a printing device with one or more supplies of print media are disclosed. An apparatus embodiment includes a sensor that detects a supply of print media and outputs a signal indicative of the detected supply of print media. The apparatus also includes a computing device that receives the signal indicative of the detected supply of print media. The computing device determines a median position of the supply of print media in a printzone of the printing device based on a plurality of trials of feeding the supply of print media into the printzone and adjusts a position in the printzone for the supply of print media where printing composition is deposited based on the determined median position of the supply of print media in the printzone. A method embodiment includes determining a range of positions of a supply of print media in a printzone of a printing device and determining a median position of the supply of print media in the printzone. The method additionally includes adjusting a position in the printzone for the supply of print media where printing composition is deposited based on the determined median position of the supply of print media in the printzone. Further characteristics and features of the apparatus and method are disclosed herein, as are exemplary alternative embodiments.

18 Claims, 5 Drawing Sheets

APPARATUS AND METHOD FOR REDUCING EDGE MARGIN TOLERANCES IN A PRINTING DEVICE WITH ONE OR MORE SUPPLIES OF PRINT MEDIA

BACKGROUND AND SUMMARY OF THE INVENTION

The present invention relates to printing devices. More particularly, the present invention relates to an apparatus and method for reducing print media edge margin tolerances in a printing device with one or more supplies of print media.

Printing devices, such as inkjet printers and laser printers, use printing composition (e.g., ink or toner) to print text, graphics, images, etc. onto a print medium in a printzone of the printing device. Inkjet printers may use print cartridges, also known as "pens", which shoot drops of printing composition, referred to generally herein as "ink", onto a print medium such as paper, transparencies or cloth. Each pen has a printhead that includes a plurality of nozzles. Each nozzle has an orifice through which the drops are fired. To print an image, the printhead is propelled back and forth across the page by, for example, a carriage while shooting drops of ink in a desired pattern as the printhead moves. The particular ink ejection mechanism within the printhead may take on a variety of different forms known to those skilled in the art, such as thermal printhead technology.

In a current thermal system, a barrier layer containing ink channels and vaporization chambers is located between an orifice plate and a substrate layer. This substrate layer typically contains linear arrays of heating elements, such as resistors, which are energized to heat ink within the vaporization chambers. Upon heating, the ink in the vaporization chamber turns into a gaseous state and forces or ejects an ink drop from an orifice associated with the energized resistor. By selectively energizing the resistors as the printhead moves across the print medium, the ink is expelled in a pattern onto the print medium to form a desired image (e.g. picture, chart and/or text).

Printing devices typically include one or more print media input devices, such as print media input trays for sheets of print media or input racks for rolls of print media. These input devices feed a supply of print media into the printzone of the printing device where printing composition is deposited on the print media to form the desired image.

Ideally, the print media is fed into the printzone each time at the same location to help assure that the image is exactly placed on the print media. However, due to design and manufacturing tolerances, such exact positioning is not possible. Instead, the supply of print media is actually positioned in a range of distances around the ideal or desired location. If this range is wide enough, then the output print quality of images from a printing device suffers. In certain instances, the output print quality may be illegible and require a new print job to be run which is wasteful and time consuming, particularly for large print jobs or print jobs that are left to run unattended, such as those that are done overnight. As a consequence, printing device throughput is also reduced. Also, usable print area may be wasted depending on where the print media is actually placed in the printzone. These problems are only exacerbated as the number of print media input devices increases because each input device has a different range of distances around the ideal or desired location, which range of distances tends to increase as an input device is positioned further from the printzone.

One way in which to help alleviate these problems is to attempt to minimize design and manufacturing tolerances which should reduce the range of distances around the ideal or desired location. This approach, however, is not without its own problems including increased complexity of both design and manufacture, as well as increased cost for such a print media input device. Again these problems are only exacerbated as the number of input devices increases.

Another approach to help alleviate these problems is to sense the edge of a print medium each time the print medium is feed into a printzone and adjust the position of where printing begins based on where the edge is located in the printzone. Such an approach, while greatly increasing image placement accuracy on a print medium and, therefore, printing device output print quality, has the drawback of decreasing printing device throughput because of the time required to sense the edge of the print medium in the printzone each time a new print medium enters the printzone, and adjust image placement accordingly.

A further approach to help alleviate these problems is to use print media registration devices that position print media correctly in the printzone. This approach, as with those that attempt to minimize design and manufacturing tolerances, is not without its own problems including increased complexity of both design and manufacture, as well as increased cost for such a print media input device. As discussed above, such problems are only exacerbated as the number of input devices increases.

Alleviation of these problems would be a welcome improvement, thereby helping minimize delay in the completion of printing tasks, helping maximize printing device throughput, and helping prevent instances of waste of print media. Accordingly, the present invention is directed to solving those problems caused by positioning of print media in a range of distances around an ideal or desired location in the printzone of a printing device. The present invention accomplishes this objective by providing an apparatus and method for reducing edge margin tolerances in a printing device with one or more supplies of print media while at the same time attempting to minimize the impact on printing device throughput.

An embodiment of a method in accordance with the present invention for use in a printing device, the printing device having a supply of print media and being configured to feed the supply of print media into a printzone where printing composition is deposited on the supply of print media, includes determining a range of positions of the supply of print media in the printzone. The method additionally includes determining a median position of the supply of print media in the printzone and adjusting a position in the printzone for the supply of print media where printing composition is deposited based on the determined median position of the supply of print media in the printzone.

In the above-described embodiment of a method in accordance with the present invention, the range of positions of an edge of the supply of print media may be determined, as can the median position of the edge of the supply of print media in the printzone. Based on the determined median position of the edge of the supply of print media in the printzone, the position in the printzone for the supply of printing media where printing composition is deposited may be adjusted.

The above-described embodiments of a method in accordance with the present invention may be modified to work with any number of additional supplies of print media where the printing device is configured to selectively feed any one of the supplies of print media into the printzone where printing composition is deposited on the selected supply of print media. Additionally, the supply or supplies of print media may comprise at least one sheet of print media in a print media input tray.

An embodiment of an apparatus in accordance with the present invention for use in a printing device, the printing device having a supply of print media and being configured to feed the supply of print media into a printzone where printing composition is deposited on the supply of print media, includes a sensor configured to detect the supply of print media and output a signal indicative of the detected supply of print media. The apparatus also includes a computing device coupled to the sensor to receive the signal indicative of the detected supply of print media. The computing device is configured to determine a median position of the supply of print media in the printzone based on a plurality of trials of feeding the supply of print media into the printzone. The computing device is further configured to adjust a position in the printzone for the supply of print media where printing composition is deposited based on the determined median position of the supply of print media in the printzone.

In the above-described embodiment of a apparatus in accordance with the present invention, the sensor may be configured to detect an edge of the supply of print media and output a signal indicative of the detected edge of the supply of print media. In such cases, the computing device is configured to determine a median position of the edge of the supply of print media in the printzone based on a plurality of trials of feeding the supply of print media into the printzone and to adjust a position in the printzone for the supply of print media where printing composition is deposited based on the determined median position of the edge of the supply of print media in the printzone.

The above-described embodiments of an apparatus in accordance with the present invention may be modified to work with any number of additional supplies of print media where the printing device is configured to selectively feed any one of the supplies of print media into the printzone where printing composition is deposited on the selected supply of print media. Additionally, the supply or supplies of print media may comprise at least one sheet of print media in a print media input tray.

An alternative embodiment of an apparatus in accordance with the present invention for use in a printing device, the printing device having a supply of print media and being configured to feed the supply of print media into a printzone where printing composition is deposited on the supply of print media, includes structure for determining a range of positions of the supply of print media in the printzone. The apparatus also includes structure for determining a median position of the supply of print media in the printzone and structure for adjusting a position in the printzone for the supply of print media where printing composition is deposited based on the determined median position of the supply of print media in the printzone.

In the above-described alternative embodiment of an apparatus in accordance with the present invention, the structure for determining a range of positions may determine the range of positions of an edge of the supply of print media in the printzone and the structure for determining a median position may determine the median position of the edge of the supply of print media in the printzone. In such cases, the structure for adjusting a position in the printzone may adjust the position in the printzone for the supply of print media where printing composition is deposited based on the determined median position of the edge of the supply of print media in the printzone.

The above-described alternative embodiments of an apparatus in accordance with the present invention may be modified to work with any number of additional supplies of print media where the printing device is configured to selectively feed any one of the supplies of print media into the printzone where printing composition is deposited on the selected supply of print media. Additionally, the supply or supplies of print media may comprise at least one sheet of print media in a print media input tray.

Other objects, advantages, and novel features of the present invention will become apparent from the following detailed description of the invention when considered in conjunction with the accompanying drawings.

DETAILED DESCRIPTION OF THE DRAWINGS

Figure 1:
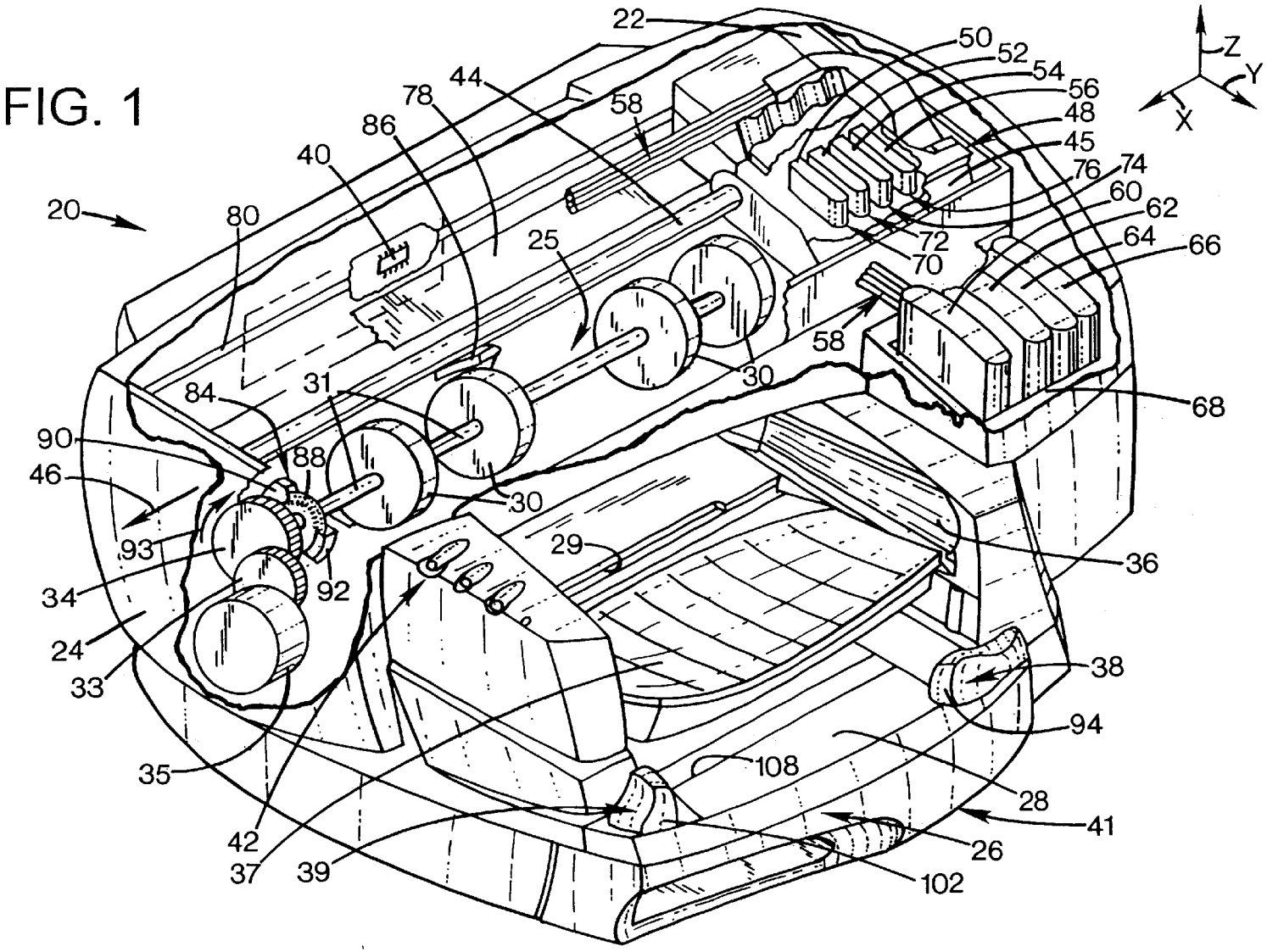
FIG. 1 is a perspective view of a printing device that includes an embodiment of the present invention.

FIG. 1 illustrates an embodiment of an inkjet printing device, sometimes referred to simply as a "printer," 20, here shown as an [a] "off-axis" inkjet printer, that includes an embodiment of the present invention and which may be used for printing business reports, correspondence, desktop publishing, and the like, in a industrial, office, home or other environment. A variety of inkjet printing devices are commercially available. For instance, some of the printing devices that may embody the present invention include plotters, portable printing units, copiers, cameras, video printers, and facsimile machines, to name a few, as well as various combination devices, such as combination facsimiles and printers. In addition, the present invention may be used in other types of printing devices such as "on-axis" inkjet printers, dot matrix printers, copiers, fax machines, and laser [jet] printers. For convenience, the concepts of the present invention are illustrated in the environment of inkjet printer 20 and an analogous generic printing device 100, which is discussed more fully below in connection with FIG. 2.

While printing device components may vary from model to model, a typical inkjet printer 20 includes a frame or chassis 22 surrounded by a housing, casing or enclosure 24, typically made of a plastic material. Sheets of print media are fed through a printzone 25 by a print media handling system 26. The print media may be any type of suitable material, such as paper, card-stock, transparencies, photographic paper, fabric, metalized media, etc. Print media handling system 26 includes a print media input tray 28 for storing sheets of print media for printing. A series of conventional print media drive rollers 30 rotate about on shaft 31 which is driven by a motor 35 through a series of drive gears 33 and 34. Gears 33 and 34 are rotateably coupled to shaft 31 to rotate shaft 31 in a direction generally indicated by arrow 93. Drive rollers 30 are used to move print media from input tray 28, through printzone 25 and, after printing, onto a pair of extendable output drying wing members 36, shown in a retracted or rest position in FIG. 1. Wings 36 momentarily hold a newly printed sheet of print media above any previously printed sheets still drying in an output tray 37. Print media handling system 26 also includes means for accommodating different sizes of print media, including letter, legal, A-4, B, envelopes, etc. This means includes a print medium length adjuster 38 and a print medium width adjuster 39. Print medium length adjuster 38 and print medium width adjuster 39 are manually repositionable against the sides of different sizes of print medium, and thereby accommodate for these different sizes. An envelope feed port 29 may be used in lieu of repositioning print medium length adjuster 38 and print medium width adjuster 39 to accommodate for the smaller size of such envelopes.

As shown in FIG. 1, print media handling system 26 also includes an additional print media input tray 41. For storing sheets of print media for printing. Drive rollers 30 are also used to move print media from input tray 41, through printzone 25 and, after printing, onto extendable output drying wing members 36, as discussed above. Although not shown in FIG. 1, it is to be understood that print media input tray 41 may also include means for accommodating different sizes of print media, including letter, legal, A-4, B, envelopes, etc., such as print medium length adjuster 38 and a print medium width adjuster 39.

The present invention may be used with printing devices that include any number of additional print media input trays for sheets of print media and/or print media racks for rolls of print media. Additionally, the present invention may be used with printing devices that include only one print media input tray for sheets of print media or only one print media rack for rolls of print media. Further, print media handling system 26 and printing device 20 may be configured to support specific print tasks such as duplex printing (i.e., printing on both sides of the sheet of print media) and banner printing.

Printing device 20 also has a computing device 40, illustrated as a microprocessor or controller, that receives instructions from a host device, typically a computer, such as a personal computer (not shown). Many of the functions of computing device 40 may be performed by a host computer, including any printing device drivers resident on the host computer, by electronics in the printing device, or by interactions between the host computer and the electronics. As used herein, the term "computing device 40" encompass these functions, whether performed by a host computer, printing device 20, an intermediary device between the host computer and printing device 20, or by combined interaction of such elements. Computing device 40 may also operate in response to user inputs provided through a keypad 42 located on the exterior of casing 24. A monitor (not shown) coupled to the computer host may be used to display visual information to a user of printing device 20, such as the printer status or a particular program being run on the host computer. Personal computers, input devices, such as a keyboard and/or a mouse device, and monitors are all known to those skilled the art.

A carriage guide rod 44 is supported by chassis 22 to slideably support an off-axis inkjet carriage 45 for travel back and forth across printzone 25 along a scanning axis generally designated by arrow 46 in FIG. 1. As can be seen in FIG. 1, scanning axis 46 is substantially parallel to be X-axis of the XYZ coordinate system shown in FIG. 1. It should be noted that the use of the word "substantially" in this document is used to account for things such as engineering and manufacturing tolerances, as well as variations not affecting performance of the present invention. Carriage 45 is also propelled along guide rod 44 into a servicing region, generally indicated by arrow 48, located within the interior of housing 24 of printing device 20. A conventional carriage drive gear and motor assembly (both of which are not shown in FIG. 1) may be coupled to drive an endless loop, which may be secured in a conventional manner to carriage 45, with the motor operating in response to control signals received from a computing device 40 to incrementally advanced carriage 45 along guide rod 44 in response to movement of the motor.

In printzone 25, a sheet of print medium receives ink from an inkjet cartridge, such as black ink cartridge 50 and three monochrome color ink cartridges 52, 54, and 56. Cartridges 50, 52, 54, and 56 are also called "pens" by those skill the art. Pens 50, 52, 54, and 56 each include small reservoirs for storing a supply of printing composition, referred to generally herein as "ink" in what is known as an "off-axis" ink delivery system, which is in contrast to a replaceable ink cartridge system where each pen has a reservoir that carries the entire ink supply as the printhead reciprocates over printzone 25 along carriage scan axis 46. The replaceable ink cartridge system may be considered an "on-axis" system, whereas systems which store the main ink supply at a stationary location remote from the printzone scanning axis are called "off-axis" systems. It should be noted that the present invention is operable in both off-axis and on-axis systems, as well as non-inkjet systems such as dot matrix and laser jet systems.

In the illustrated off-axis printing device 20, ink of each color from each printhead is delivered via a conduit or tubing system 58 from a group of main ink reservoirs 60, 62, 64, and 66 to the on-board reservoirs of respective pens 50, 52, 54, and 56. Ink reservoirs 60, 62, 64, and 66 are replaceable ink supplies stored in a receptacle 68 supported by printer chassis 22. Each of pens 50, 52, 54, and 56 has a respective printhead, as generally indicated by arrows 70, 72, 74, and 76, which selectively ejects ink to form an image on a print medium in printzone 25.

Printheads 70,72, 74, and 76 each have an orifice plate with a plurality of nozzles formed therethrough in a manner well-known to those skill the art. The illustrated printheads 70,72, 74, and 76 are thermal inkjet printheads, although other types of printheads may be used, such as piezoelectric printheads. Thermal printheads 70,72, 74, and 76 typically include a plurality of resistors which are associated with the nozzles. Upon energizing a selected resistor, a bubble of gas is formed which ejects a droplet of ink from the nozzle onto the print medium in printzone 25 under the nozzle. The printhead resistors are selectively energized in response to firing command control signals delivered by a multi-conductor strip 78 (a portion of which is shown in FIG. 1) from computing device 40 to printhead carriage 45.

An optical quadrature encoder strip 80 extends along the length of printzone 25 and over the area of service station region 48 to provide carriage 45 positional feedback information to computing device 40, with a carriage position quadrature encoder reader (not shown in FIG. 1) being mounted on a back surface of printhead carriage 45 to read positional information provided by optical quadrature encoder strip 80. Together, optical quadrature encoder strip 80 and carriage position quadrature encoder reader constitute a printing device carriage position quadrature encoder. Printing device 20 uses optical quadrature encoder strip 80 and the carriage position quadrature encoder reader to trigger the firing of printheads 70,72, 74, and 76 and to provide feedback for position and velocity of carriage 45.

Optical encoder strip 80 may be made from things such as photo imaged MYLAR brand film, and works with a light source and a light detector (both of which are not shown in FIG. 1) of carriage position quadrature encoder reader. The light source directs light through strip 80 which is received by the light detector and converted into an electrical signal which is used by computing device 40 of printing device 20 to control firing of printheads 70, 72, 74, and 76 and to control carriage 45 position and velocity. Markings or indicia on encoder strip 80 periodically block this light from the light detector of carriage position quadrature encoder reader in a predetermined manner which results in a corresponding change in the electrical signal from the detector of carriage position quadrature encoder reader which is processed by computing device 40.

A print medium axis position quadrature encoder 84 is also shown in FIG. 1. Print medium axis position quadrature encoder 84 provides positional feedback information to computing device 40 regarding the position of print media drive rollers 30. Printing device 20 uses print medium axis position quadrature encoder 84 in combination with flag 86 to help accurately position print medium in printzone 25 and to control printing by one or more of printheads 70, 72, 74, and 76. Flag 86 detects the presence of print medium in printzone 25. Print medium axis position quadrature encoder 84 includes a rotary encoder 88 and a pair of rotary encoder readers 90 and 92. Rotary encoder 88 is coupled to shaft 31 to rotate therewith in the direction generally indicated by arrow 93.

Rotary encoder 88 may be made from things such as photo imaged MYLAR brand film, and works with a light source and a light detector (both of which are not shown) of each of rotary encoder readers 90 and 92. These light sources direct light through rotary encoder 88 which is received by the light detectors and converted into an electrical signal which is used by computing device 40 of printing device 20 to help accurately position print medium in printzone 25 and to control firing of printheads 70, 72, 74, and 76. Markings or indicia on rotary encoder 88 periodically block this light from the light detectors of rotary encoder readers 90 and 92 in a predetermined manner which results in a corresponding change in the electrical signal from the detectors of rotary encoder readers 90 and 92 which is processed by computing device 40.

Figure 2:
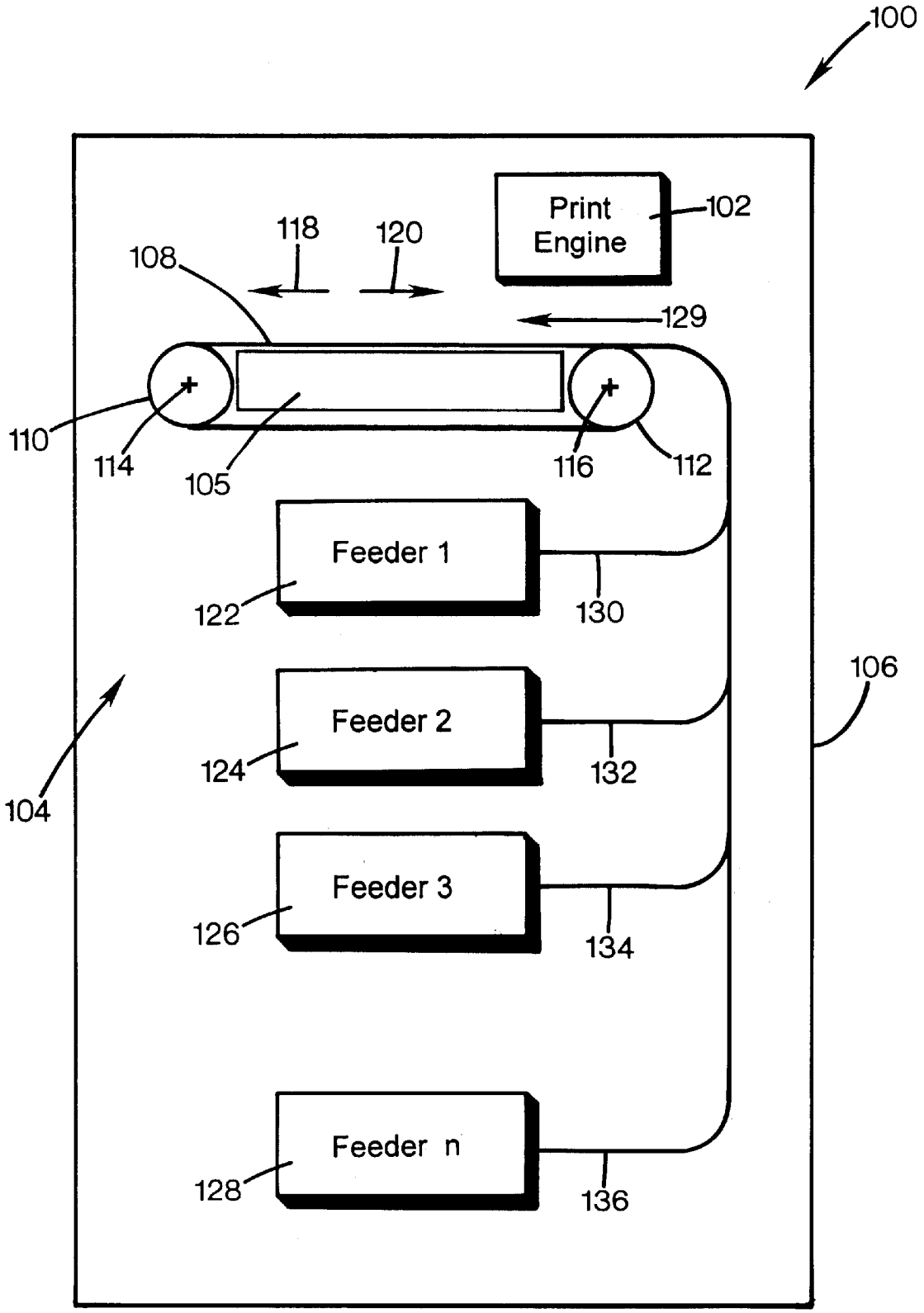
FIG. 2 is a diagrammatic view of an alternative embodiment of a printing device that includes an embodiment of the present invention.

A schematic view of an alternative embodiment of a printing device 100 that also includes an embodiment of the present invention is shown in FIG. 2. Some of the major elements of printing device 100 are shown in FIG. 2, including print engine 102, print media handling system 104, vacuum plenum 105, and housing or casing 106.

Print engine 102 may comprise any type of apparatus by which an image is recorded on a print medium, including inkjet printing mechanisms like those discussed above in connection with FIG. 1 and laser jet printing mechanisms. A computing device (not shown) like, for example, computing device 40 is used to control formation of images on print media by print engine 102.

Print media handling system 104 includes a belt or web transport 108 that is disposed around a pair of driven rollers 110 and 112. Rollers 110 and 112 may be selectively driven by the computing device (not shown) of printing device 100 and one or more motors and drive gears (both of which are not shown) so as to rotate about points 114 and 116 in either a clockwise or counter-clockwise direction which allows belt transport 108 to selectively move in either of the directions indicated by arrows 118 and 120. Belt transport 108 is in fluid communication with vacuum plenum 105 by, for example, a plurality of apertures (not shown) formed though belt transport 108. In this manner, print medium is held down on belt transport 108 for the span of the length of vacuum plenum 105 and can be moved to and from printzone 129 any number of times. This span may be changed by resizing the dimensions of vacuum plenum.

As can also be seen in FIG. 2, print media handing system 104 also includes a plurality of print media feeders 122, 124, 126, and 128. Feeders 122, 124, 126, and 128 each include a tray for sheets of print media or a rack for a roll of print media, as well as the necessary components to transport print media to printzone 129 of printing device 100 for printing by print engine 102 via feed paths 130, 132, 134, and 136. Feeders 122, 124, 126, and 128 may each be separately configured to hold various sized print media or fixed sized print media. The computing device (not shown) of printing device 100 is also coupled to each of feeders 122, 124, 126, and 128 to control selective transport of print media from any one of feeders 122, 124, 126, and 128 to printzone 129 for printing of images by print engine 102.

As discussed above, the present invention may be used with printing devices having any number of print media input trays and/or racks which is noted in FIG. 2 through the use of the designation "Feeder n" for feeder 128. Also, although not shown in FIG. 2, it is to be understood that printing device 100 includes many of the same components of printing device 20 which may be necessary for operation, such as one or more print media output trays or racks, a user interface, and one or more position encoders.

Figure 3:
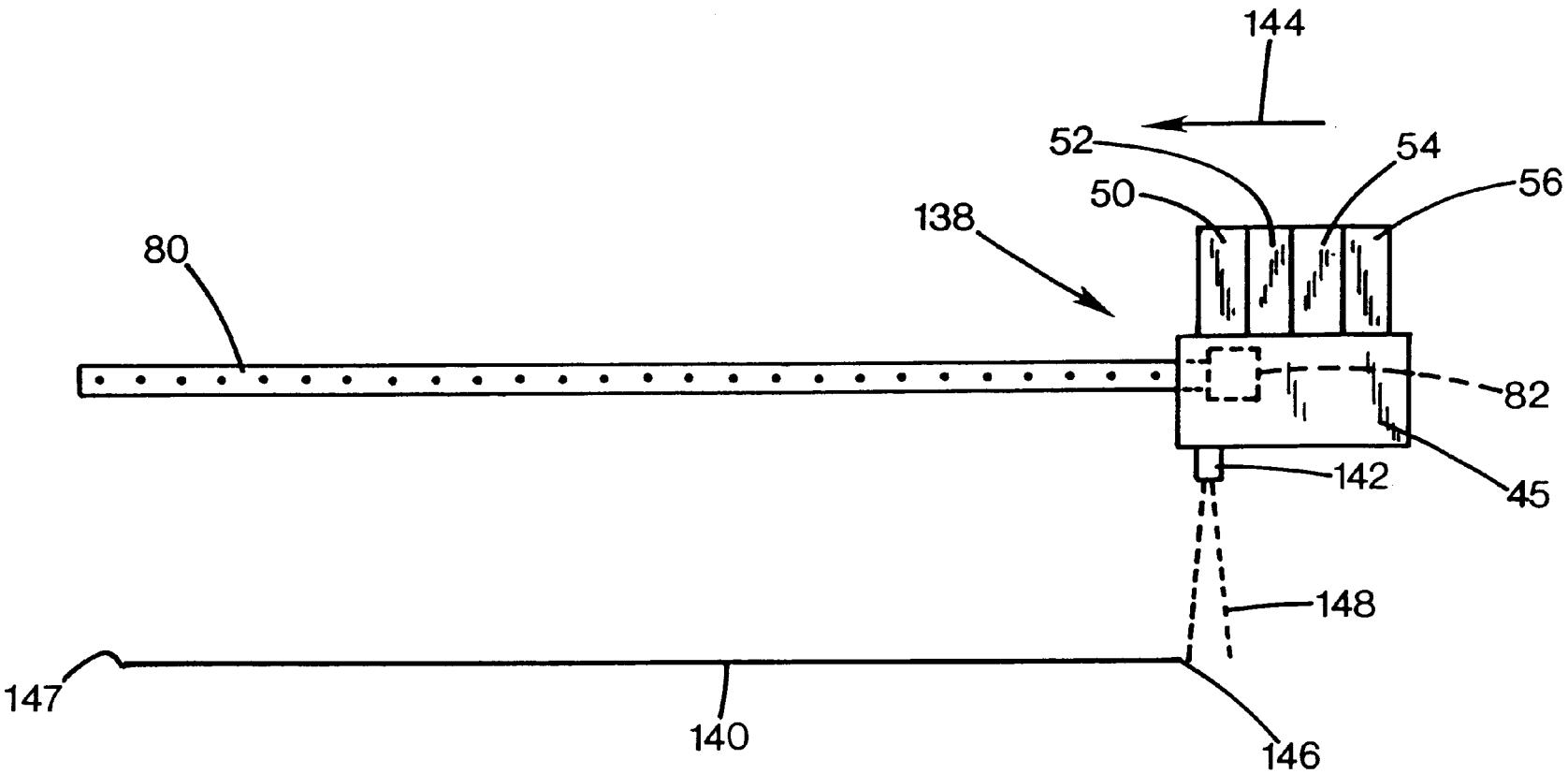
FIG. 3 is a side view of a print medium edge sensor in accordance with the present invention configured to detect an edge of a print medium.

A side view of a print medium edge sensor 138 constructed in accordance with the present invention is shown in FIG. 3. Print medium edge sensor 138 is configured to detect an edge of a print medium transported by either print media handling system 26 or print media handling system 104 to respective printzone 25 or printzone 129, such as print medium 140. Although some of the components of the print engine of printing device 20 are illustrated in FIG. 3, it is to be understood that print medium edge sensor 138 of the present invention may also be used with print engine 102 of printing device 100, as well as with print engines of other printing devices.

As can be seen in FIG. 3, an embodiment of print medium edge sensor 138 includes optical quadrature encoder strip 80, carriage position quadrature encoder reader 82, and a print medium edge detector 142.

In operation, print medium 140 is transported from either input tray 28 or input tray 41 to printzone 25 by print media handling system 26. Upon entering printzone 25, carriage 45 is moved in the direction of arrow 144 so that edge 146 of print medium 140 is detected by beam 148 of print medium edge detector 142. Upon detection of edge 146, the position on optical quadrature encoder strip 80 is recorded. A signal from sensor 138 is sent to computing device 40 indicating the position on optical quadrature encoder strip 80 at which edge 146 of print medium 140 was detected.

Ideally, the print media is fed into printzone 25 or 129 each time at the same location to help assure that the image is exactly placed on the print media. However, due to design and manufacturing tolerances, such exact positioning is not possible. Instead, the supply of print media is actually positioned in a range of distances around the ideal or desired location. If this range is wide enough, then the output print quality of images from a printing device 20 or 100 suffers. In certain instances, the output print quality may be illegible and require a new print job to be run which is wasteful and time consuming, particularly for large print jobs or print jobs that are left to run unattended, such as those that are done overnight. As a consequence, printing device 20 or 100 throughput is also reduced. Also, usable print area may be wasted depending on where the print media is actually placed in printzone 25 or 129. These problems are only exacerbated as the number of print media input devices increases because each input device has a different range of distances around the ideal or desired location, which range of distances tends to increase as an input device is positioned further from printzone 25 or 129.

One way in which to help alleviate these problems is to attempt to minimize design and manufacturing tolerances which should reduce the range of distances around the ideal or desired location. This approach, however, is not without its own problems including increased complexity of both design and manufacture, as well as increased cost for such a print media input device. Again these problems are only exacerbated as the number of input devices increases.

Another approach to help alleviate these problems is to sense the edge of a print medium each time the print medium is feed into printzone 129 and adjust the position of where printing begins based on where the edge is located in printzone 25 or 129. Such an approach, while greatly increasing image placement accuracy on the print medium and, therefore, printing device 20 or 100 output print quality, has the drawback of decreasing printing device 100 throughput because of the time required to sense the edge of the print medium in printzone 25 or 129 each time a new print medium enters printzone 25 or 129, and adjust the image placement accordingly.

A further approach to help alleviate these problems is to use print media registration devices that position print media correctly in printzone 25 or 129. This approach, as with those that attempt to minimize design and manufacturing tolerances, is not without its own problems including increased complexity of both design and manufacture, as well as increased cost for such a print media input device. As discussed above, such problems are only exacerbated as the number of input devices increases.

Alleviation of these problems would be a welcome improvement, thereby helping minimize delay in the completion of printing tasks, helping maximize printing device throughput, and helping prevent instances of waste of print media. Accordingly, the present invention is directed to solving those problems caused by positioning of print media in a range of distances around an ideal or desired location in the printzone of a printing device. The present invention accomplishes this objective by providing an apparatus and method for reducing edge margin tolerances in a printing device with one or more supplies of print media while at the same time attempting to minimize the impact on printing device throughput.

Referring again to FIG. 3, in accordance with the present invention, computing device 40 of printing device 20 actuates print media handling system 26 to transport print media from print media input tray 28 to printzone 25 and also from print media input tray 41 to printzone 25 multiple times for each print media input tray to determine the range of positions of edge 146 of print media 140 in printzone 25 for print media input tray 28 and also for print media input tray 41. Similarly, in accordance with the present invention, the computing device (not shown) of printing device 100 actuates print media handling system 104 to transport print media from print media feeders 122, 124, 126, and 128 to printzone 129 multiple times for each print media feeder 122, 124, 126, and 128 to determine the range of positions of the edge of print media in printzone 129 for print media feeders 122, 124, 126, and 128. Edge sensing by print medium edge detector 142 is dispensed with subsequent to the determination of such range of positions. As discussed above, the lack of the requirement to sense the edge of a print medium each time the print medium is feed into a printzone and adjust the position of where image printing begins based on that detected edge increases throughput of the printing device.

Figure 4:
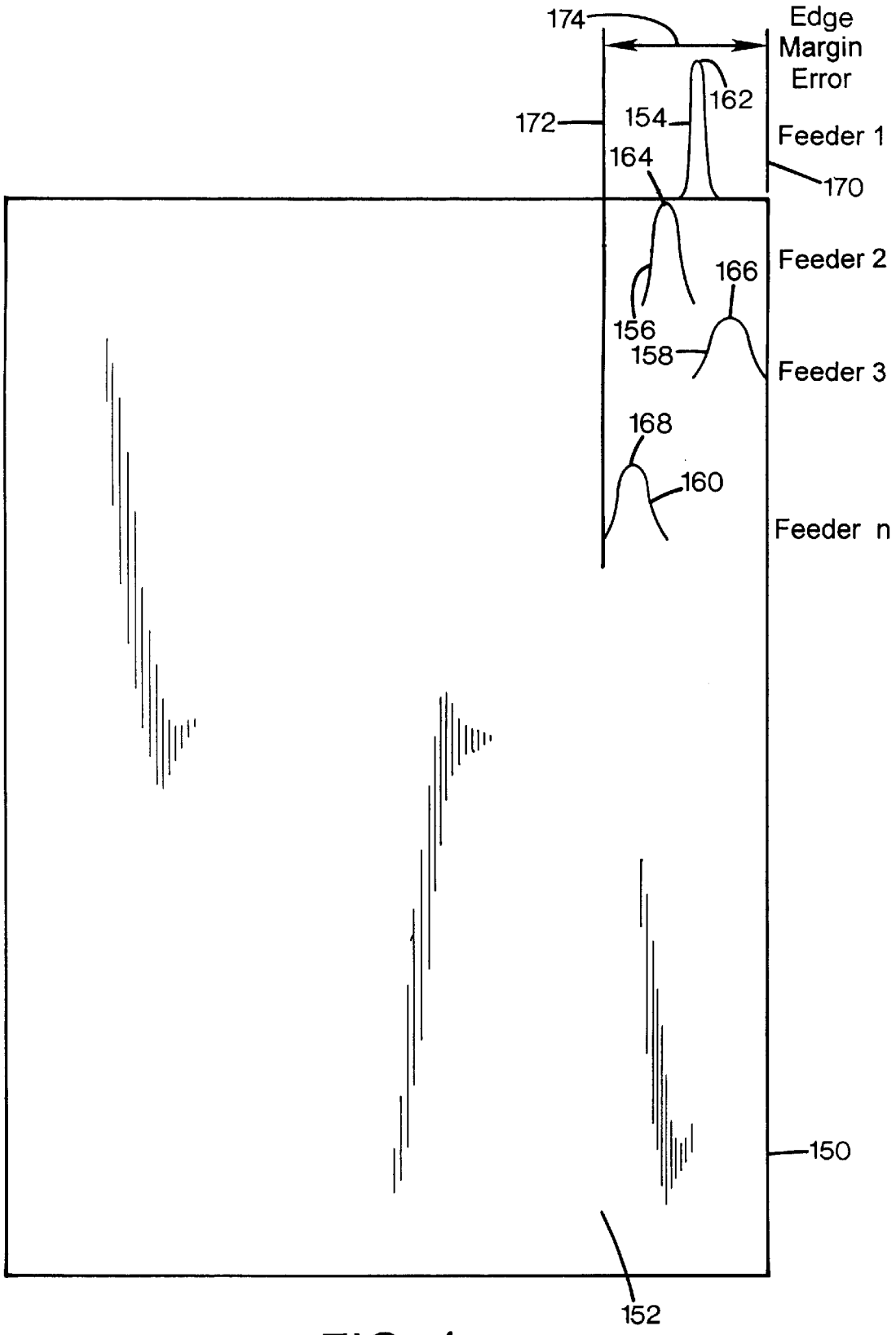
FIG. 4 is a diagram illustrating ranges of positions of edges of supplies of print media in a printzone of the printing device shown in FIG. 2, and also an ideal edge location for a sheet of print media in the printzone of the printing device shown in FIG. 2.

A diagram illustrating determined ranges of positions of edges of supplies of print media 154, 156, 158, and 160 from respective feeders 122, 124, 126, and 128 in printzone 129 of the printing device 100 is shown in FIG. 4. Ranges 154, 156, 158, and 160 are determined by the computing device (not shown) of printing device 100 from signals received from print medium edge sensor 138. Also shown in FIG. 4 is an ideal edge location 150 for sheets of print media like sheet of print media 152 in printzone 129 of printing device 100. Although not shown, it is to be understood that a diagram for print media input trays 29 and 41 of printing device 20 would have distributions similar to those shown in FIG. 4.

As can be seen in FIG. 4, each of the determined ranges of positions 154, 156, 158, and 160 has a generally Gaussian or normal probability distribution. As can also be seen in FIG. 4, the edge margin error for all of feeders 122, 124, 126, and 128 taken together extends over a range of sheet of print media 152 defined by lines 170 and 172, and arrow 174.

Figure 5:
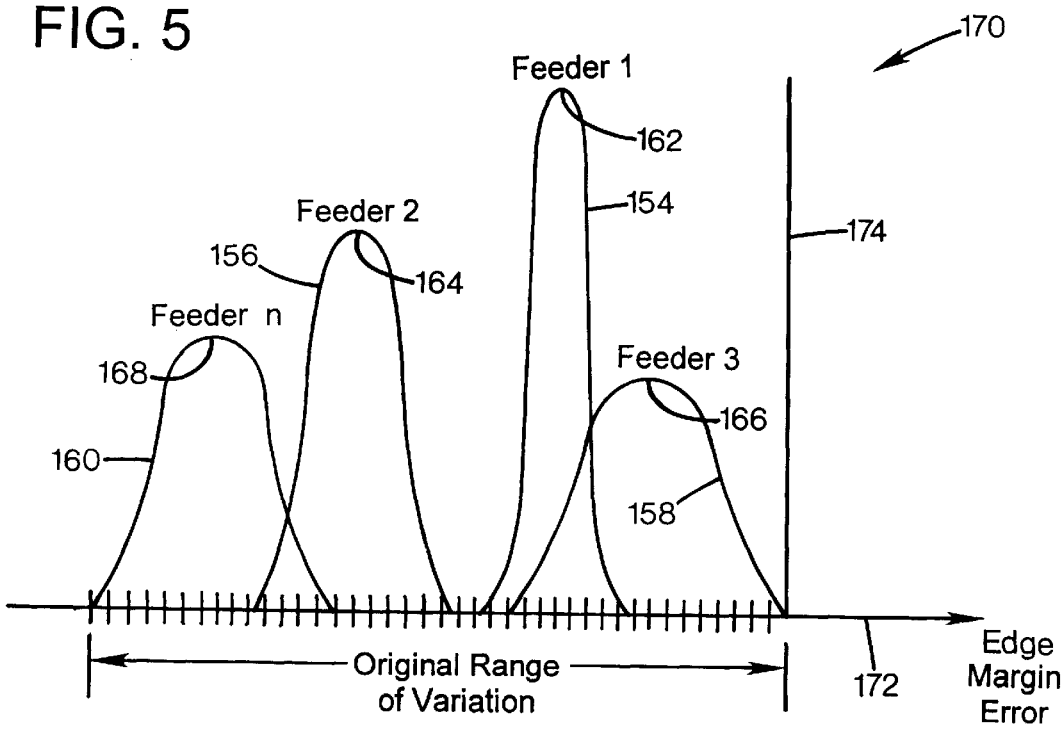
FIG. 5 is a graph of probability distributions of determined ranges of edges of supplies of print media in the printzone of the printing device shown in FIG. 2 for each feeder of the printing device.

A graph 170 of these probability distributions of the determined ranges of positions 154, 156, 158, and 160 is shown in FIG. 5. In accordance with the present invention, the computing device (not shown) of printing device 100 is configured to determine the median positions 162, 164, 166, and 168 of each of the edges of the supplies of print media from each of respective feeders 122, 124, 126, and 128 in printzone 129. These edges are those that correspond to edge 150 of sheet of print media 152 which are detected by a print medium edge sensor like print medium edge sensor 138, as discussed above in connection with FIG. 3. Median position 162 represents the most frequent location of an edge of a print medium from feeder 122 in printzone 129. Median position 164 represents the most frequent location of an edge of a print medium from feeder 124 in printzone 129. Median position 166 represents the most frequent location of an edge of a print medium from feeder 126 in printzone 129. Median position 168 represents the most frequent location of an edge of a print medium from feeder 128 in printzone 129.

Also in accordance with the present invention, the computing device (not shown) of printing device 100 adjusts the position in printzone 129 for each of the supplies of print media from feeders 122, 124, 126, and 128 where printing composition is deposited based on the determined median position of the edge of the supply of print media in printzone 129. For example, for print media from feeder 122 (Feeder 1), the computing device (not shown) of printing device 100 is configured to adjust or shift the edge of the image to be printed by print engine 102 in printzone 129 fourteen (14) units on x-axis 172 to the left of y-axis 174, where y-axis 174 represents the ideal location of any edge of print media in printzone 129 of printing device 100. For print media from feeder 126 (Feeder 3), the computing device of printing device 100 is configured to adjust or shift the edge of the image to be printed by print engine 102 in printzone 129 to a lesser degree than for Feeder 1, only nine (9) units on x-axis 172 to the left of y-axis 174. For print media from feeder 124 (Feeder 2), the computing device of printing device 100 is configured to adjust or shift the edge of the image to be printed by print engine 102 in printzone 129 to a greater degree than for Feeder 1, twenty-six (26) units on x-axis 172 to the left of y-axis 174. Even greater adjustment, thirty-five (35) units on x-axis 126 to the left of y-axis 174, occurs for Feeder n. Each of these adjustments or shifts occurs automatically based only on the feeder from which the print media is supplied. No print medium edge sensing occurs each time the print medium is feed into printzone 129 which helps increase throughput of printing device 100, as discussed above.

Figure 6:
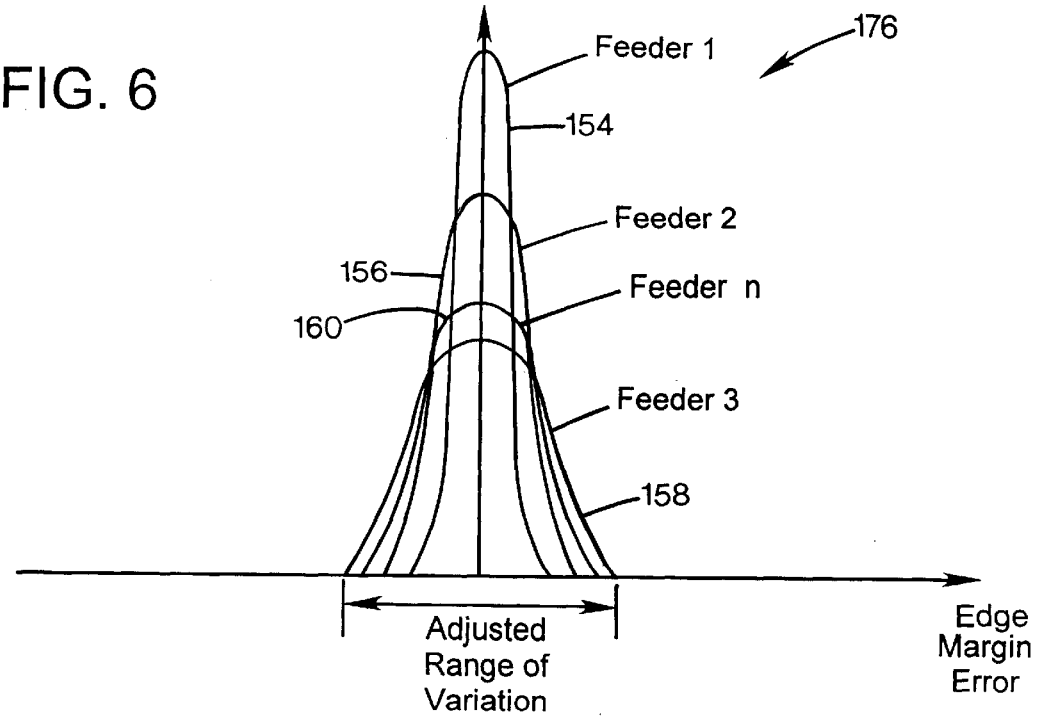
FIG. 6 is a graph of probability distributions of the ranges of edges of supplies of print media in the printzone for each feeder of the printing device shown in FIG. 2 after adjustment of where printing occurs in the printzone for each feeder in accordance with the present invention.

A graph 176 of probability distributions of the ranges of edges of supplies of print media in printzone 129 for each of feeders 122, 124, 126, and 128 of printing device 100 after adjustment of where printing occurs in the printzone for each of feeders 122, 124, 126, and 128 in accordance with the present invention is shown in FIG. 6. As can be seen by comparing FIGS. 5 and 6, the overall adjusted range of variation of where image edge printing begins for printing device 100, as shown in FIG. 6, is smaller than the unadjusted original overall range of variation shown in FIG. 5. The adjusted range of variation is smaller because the present invention automatically adjusts or shifts the edge of the image to be printed by print engine 102 in printzone 129 of printing device 100 based on the determined median edge position for the particular feeder from which the print medium is being fed.

Although the invention has been described and illustrated in detail, it is to be clearly understood that the same is intended by way of illustration and example only, and is not to be taken necessarily, unless otherwise stated, as an express limitation. For example, although the probability distributions of the ranges of positions for the edges of the supplies of print media in the printzone were illustrated as Gaussian or normal, the present invention is configured to operate with other probability distributions as well. As another example, in one or more alternative embodiments of the present invention, edges 146 and 147 of print medium 140 may be detected by print medium edge sensor 138 and optical quadrature encoder strip 80. From this edge information, the center of print medium 140 may be determined, as can the median position of the center of print medium 140 after transport of print medium 140 from print media input tray 28 to printzone 25 multiple times or transport of print medium 140 from print media input tray 41 to printzone 25 multiple times. Once this median position is determined, the position in printzone 25 for print medium 140 where printing composition is deposited can be adjusted based on this determined median position of the center of print medium 140 for each print media input tray or rack. It should be noted, that this alternative technique, in accordance with the present invention, may be applied as well to supplies of print media from respective feeders 122, 124, 126, and 128. The spirit and scope of the present invention are to be limited only by the terms of the following claims.

What is claimed is:

1. A method for use in a printing device, the printing device including a supply of print media and the printing device being configured to feed the supply of print media into a printzone where printing composition is deposited on the supply of print media, the method comprising:

determining a range of positions of the supply of print media in the printzone;

determining a median position of the supply of print media in the printzone; and adjusting a position in the printzone for the supply of print media where printing composition is deposited based on the determined median position of the supply of print media in the printzone.

2. The method of claim 1, wherein the range of positions of an edge of the supply of print media in the printzone is determined, the median position of the edge of the supply of print media in the printzone is determined, and the position in the printzone for the supply of print media where printing composition is deposited is adjusted based on the determined median position of the edge of the supply of print media in the printzone.

3. The method of claim 1, wherein the supply of print media comprises at least one sheet of print media in a print media input tray.

4. A method for use in a printing device, the printing device including a first supply of print media and a second supply of print media, and the printing device being configured to selectively feed one of the first supply of print media into a printzone where printing composition is deposited on the first supply of print media and the second supply of print media into the printzone where printing composition is deposited on the second supply of print media, the method comprising:

determining a range of positions of the first supply of print media in the printzone;

determining a range of positions of the second supply of print media in the printzone;

determining a median position of the first supply of print media in the printzone;

determining a median position of the second supply of print media in the printzone;

adjusting a position in the printzone for the first supply of print media where printing composition is deposited based on the determined median position of the first supply of print media in the printzone; and adjusting a position in the printzone for the second supply of print media where printing composition is deposited based on the determined median position of the second supply of print media in the printzone.

5. The method of claim 4, wherein the range of positions of an edge of the first supply of print media in the printzone is determined, the range of positions of an edge of the second supply of print media in the printzone is determined, the median position of the edge of the first supply of print media in the printzone is determined, the median position of the edge of the second supply of print media in the printzone is determined, the position in the printzone for the first supply of print media where printing composition is deposited is adjusted based on the determined median position of the edge of the first supply of print media in the printzone, and the position in the printzone for the second supply of print media where printing composition is deposited is adjusted based on the determined median position of the edge of the second supply of print media in the printzone.

6. The method of claim 4, wherein at least one of the first supply of print media and the second supply of print media comprise at least one sheet of print media in a print media input tray.

7. An apparatus for use in a printing device, the printing device including a supply of print media and the printing device being configured to feed the supply of print media into a printzone where printing composition is deposited on the supply of print media, the apparatus comprising:

a sensor configured to detect the supply of print media and output a signal indicative of the detected supply of print media; and a computing device coupled to the sensor to receive the signal indicative of the detected supply of print media, the computing device being configured to determine a median position of the supply of print media in the printzone based on a plurality of trials of feeding the supply of print media into the printzone, and the computing device being further configured to adjust a position in the printzone for the supply of print media where printing composition is deposited based on the determined median position of the supply of print media in the printzone.

8. The apparatus of claim 7, wherein the sensor is configured to detect an edge of the supply of print media and output a signal indicative of the detected edge of the supply of print media, and further wherein the computing device is configured to determine a median position of the edge of the supply of print media in the printzone based on a plurality of trials of feeding the supply of print media into the printzone, and the computing device is still further configured to adjust a position in the printzone for the supply of print media where printing composition is deposited based on the determined median position of the edge of the supply of print media in the printzone.

9. The apparatus of claim 7, wherein the supply of print media comprises at least one sheet of print media in a print media input tray.

10. An apparatus for use in a printing device, the printing device including a plurality of supplies of print media and the printing device being configured to selectively feed any one of the supplies of print media into a printzone where printing composition is deposited on the selected supply of print media, the apparatus comprising:

a sensor configured to detect each of the supplies of print media and output a signal indicative of each of the detected supplies of print media; and a computing device coupled to the sensor to receive the signal indicative of each of the supplies of print media, the computing device being configured to determine a median position of each of the supplies of print media in the printzone based on a plurality of trials of feeding each of the supplies of print media into the printzone, and the computing device being further configured to adjust a position in the printzone for each of the supplies of print media where printing composition is deposited based on the determined median position of the supply of print media in the printzone.

11. The apparatus of claim 10, wherein the sensor is configured to detect an edge of each of the supplies of print media and output a signal indicative of the detected edge of each of the supplies of print media, and further wherein the computing device is configured to determine a median position of the edge of each of the supplies of print media in the printzone based on a plurality of trials of feeding the supply of print media into the printzone, and the computing device is still further configured to adjust a position in the printzone for the supply of print media where printing composition is deposited based on the determined median position of the edge of the supply of print media in the printzone.

12. The apparatus of claim 10, wherein at least one of the supplies of print media comprises at least one sheet of print media in a print media input tray.

13. An apparatus for use in a printing device, the printing device including a supply of print media and the printing device being configured to feed the supply of print media into a printzone where printing composition is deposited on the supply of print media, the apparatus comprising:

means for determining a range of positions of the supply of print media in the printzone;

means for determining a median position of the supply of print media in the printzone; and means for adjusting a position in the printzone for the supply of print media where printing composition is deposited based on the determined median position of the supply of print media in the printzone.

14. The apparatus of claim 13, wherein the means for determining a range of positions determines the range of positions of an edge of the supply of print media in the printzone, the means for determining a median position determines the median position of the edge of the supply of print media in the printzone, and the means for adjusting a position in the printzone adjusts the position in the printzone for the supply of print media where printing composition is deposited based on the determined median position of the edge of the supply of print media in the printzone.

15. The apparatus of claim 13, wherein the supply of print media comprises at least one sheet of print media in a print media input tray.

16. An apparatus for use in a printing device, the printing device including a plurality of supplies of print media and the printing device being configured to selectively feed any one of the supplies of print media into a printzone where printing composition is deposited on the selected supply of print media, the apparatus comprising:

means for determining a range of positions of each of the supplies of print media in the printzone;

means for determining a median position of each of the supplies of print media in the printzone; and means for adjusting a position in the printzone for each of the supplies of print media where printing composition is deposited based on the determined median position of the supply of print media in the printzone.

17. The apparatus of claim 16, wherein the means for determining a range of positions determines the range of positions of an edge of each of the supplies of print media in the printzone, the means for determining a median position determines the median position of the edge of each of the supplies of print media in the printzone, and the means for adjusting a position in the printzone adjusts the position in the printzone for the supply of print media where printing composition is deposited based on the determined median position of the edge of the supply of print media in the printzone.

18. The apparatus of claim 16, wherein at least one of the supplies of print media comprises at least one sheet of print media in a print media input tray.

* * * * *